US006202253B1

(12) United States Patent
Green

(10) Patent No.: US 6,202,253 B1
(45) Date of Patent: Mar. 20, 2001

(54) STORM DOOR CYLINDER LOCK

(75) Inventor: Matthew Green, Warren, MI (US)

(73) Assignee: Universal Friendly Technologies LLC, Richmond, MI (US)

( * ) Notice: Subject to any disclaimer, the term of this patent is extended or adjusted under 35 U.S.C. 154(b) by 0 days.

(21) Appl. No.: 09/182,159

(22) Filed: Oct. 29, 1998

(51) Int. Cl.[7] ..... E05F 3/00
(52) U.S. Cl. ..... 16/70; 16/71; 16/51; 16/49
(58) Field of Search ..... 16/70, 71, 55, 16/60, 80

(56) References Cited

U.S. PATENT DOCUMENTS

| | | | |
|---|---|---|---|
| 3,156,001 | | 11/1964 | Schmid . |
| 3,156,002 | | 11/1964 | Schmid . |
| 3,538,537 | | 11/1970 | Strauss . |
| 3,601,842 | | 8/1971 | Morrison . |
| 3,630,560 | | 12/1971 | Atkins . |
| 3,655,228 | | 4/1972 | Coopersmith et al. . |
| 3,708,825 | | 1/1973 | Wood . |
| 3,785,004 | | 1/1974 | Stoffregen . |
| 4,048,695 | * | 9/1977 | Juilfs ..... 16/65 |
| 4,357,731 | | 11/1982 | Strauss . |
| 4,894,883 | | 1/1990 | Fleischhauer . |
| 4,932,695 | | 6/1990 | Pettit et al. . |
| 5,529,148 | * | 6/1996 | O'Leary ..... 16/49 |
| 5,832,562 | * | 11/1998 | Luca ..... 16/71 |
| 5,842,255 | * | 12/1998 | Luca ..... 16/51 |

* cited by examiner

*Primary Examiner*—Anthony Knight
*Assistant Examiner*—Mark Williams
(74) *Attorney, Agent, or Firm*—Harness, Dickey & Pierce, PLC

(57) ABSTRACT

A cylinder lock door closure device. In an exemplary application, the cylinder lock door closure device includes a cylindrical housing, a piston assembly, an arm assembly, a cylindrical catch piece and a hard stop whereby when a door is opened past 90° open, it will automatically lock in an open position. When the door is tapped toward the open position, the automatic lock will be released and the door returned to a closed position.

16 Claims, 4 Drawing Sheets

STORM DOOR CYLINDER LOCK

BACKGROUND OF THE INVENTION

1. Technical Field

The present invention generally relates to a cylinder lock door closer for storm doors, screen doors and the like. More particularly, the present invention relates to a cylinder lock door closer for storm doors, screen doors and the like which retains a door in its open position, while permitting the door to close under spring action, after a pulse of further opening pressure is applied to the door.

2. Discussion

In many buildings, storm doors or screen doors and the like are mounted outside the primary doors of the structure. Such doors almost always will not stay open unless held open by the user or a door closer device is manually positioned so as to hold the door in its open position. Usually, a compression spring is used to immediately return and close such secondary doors after they are released by the user.

In many cases, however, it is desirable that the secondary door be left open when the user is going back and forth through the door, has both arms occupied, is elderly, handicapped, or not ambulatory as in a wheelchair, or is simply attempting to open the primary door while still being able to immediately close the secondary door with relatively little effort.

In many door closers of the telescoping spring return type, a braking mechanism is mounted on a central telescoping piston rod to hold the door open. This type of design operates when the brake, usually a clip or washer located about the piston rod, is manually positioned to prevent the piston rod from retracting into a spring-containing housing. A difficulty with this type of closure is that it must be manually set and released, which is inconvenient if a person's hands and arms are occupied, such as when the person is carrying a large object or numerous objects through the doorway, or if the person is elderly, handicapped, or not ambulatory as in a wheelchair. Therefore, it is desirable to have a cylinder lock door closure device which allows a door to remain in its open position, and immediately return and close with relatively little effort from the user.

SUMMARY OF THE INVENTION

It is a general object of the present invention to provide a cylinder lock door closure device for storm doors which retains a door in its open position, while permitting the door to close under spring action, after a pulse of further opening pressure is applied to the door.

It is a more particular object of the present invention to provide a cylinder lock door closure device of simplified construction having a totally internal mechanism which will permit the user to open the door to a point where an internal mechanism will hold the door in an open position, and hold it there until the door is released by applying a small amount of opening pressure to the door.

It is another object of the present invention to provide a cylinder lock door closure device which allows a user to enter or exit a doorway when their hands and arms are occupied, such as when a large object is or numerous objects are being carried through the doorway, without having to put the item down to lock the door in its open position or release the door from its open position.

It is an object of the present invention to provide a cylinder lock door closure device which allows the user to immediately close the door after entering the building structure, which in turn saves on heating and cooling loss, and insect entry.

It is another object of the present invention to provide a cylinder lock door closure device which provides elderly users, handicapped users, and non-ambulatory users, as in a wheelchair, special assistance in entering and exiting a building structure.

It is an object of the present invention to provide a cylinder lock door closure device which relieves a user from resting the secondary door against their body while unlocking the primary door.

It is another object of the present invention to provide a cylinder lock door closure device wherein the holding mechanism is completely internal of the device so as not likely to be effected by the elements and is cosmetically identical to existing door closure devices.

It is an object of the present invention to provide a cylinder lock door closure device which replaces an existing door closure device, including a clip or washer located about the piston rod in order to prevent the piston rod from retracting into the cylinder.

In one form, the present invention provides a cylinder lock door closure device for retaining a door in its open position, while permitting the door to close under spring action, after a pulse of further opening pressure is applied to the door. The cylinder lock door closure device includes an arm assembly interacting with a catch piece.

Further areas of applicability, and additional benefits and advantages of the present invention will become apparent to those skilled in the art to which this invention relates from a reading of the subsequent description of the preferred embodiment and the appended claims, taken in conjunction with the accompanying drawings. It should be understood, however, that the detailed description and specific examples, while indicating preferred embodiments of the invention, are intended for purposes of illustration only, since various changes and modification s within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
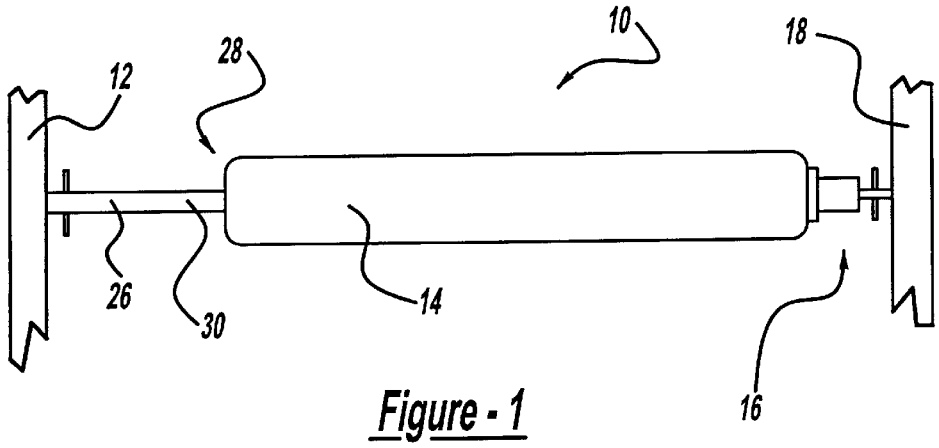
FIG. 1 is an environmental view of a cylinder lock door closure device constructed in accordance with the teachings of a preferred embodiment of the present invention and shown operatively installed within a building structure.

Referring now to the drawings, there is depicted a cylinder lock door closure device embodying the concepts of the present invention The cylinder lock door closure device of the present invention is generally identified in the drawings with reference numeral 10 and is shown through the drawings adapted to cooperate with a specific door 12 of a building structure. However, it will become apparent below that the teachings of the present invention are more broadly applicable to a large range of doors associated with a large range of building structures.

Prior to addressing the construction and operation of the cylinder lock door closure device 10 of the present invention, a brief understanding of an exemplary door closure device shown in the drawings is warranted. The environmental view of FIG. 1 illustrates the cylinder lock door closure device 10 operatively located in a doorway of a building structure. The cylinder lock door closure device 10 illustrated is otherwise of conventional construction and shown to generally include an outer cylinder 14 connected at one end 16 to a door frame 18 of the building structure, a spring loaded piston assembly 20 including a damping spring 22 and a piston head 24 rectilinearly displaceable in the outer cylinder 14, and a piston rod 26 fixed to the piston head 24 and extending from another end 28 of the outer cylinder 14. An exposed or free end 30 of the piston rod 26 is pivotally connected to the door 12. A stop clip or stop washer (not shown) is located about the exposed or free end 30 of the piston rod 26. It is appreciated that the one end 16 of the outer cylinder 14 may be connected to either the door frame 18 or the door 12, while the exposed or free end 30 of the piston rod 26 would be pivotally connected to the other of either the door 12 or the door frame 18.

Thus, in operation, air enters the outer cylinder 14 freely as the door 12 is opened. The air escapes at a controlled rate through a suitable orifice (not shown) as the door 12 is spring closed, thereby checking and controlling the rate of speed at which the door 12 is closed by an air cushion or damping action.

With continued reference to FIGS. 2A–4, the cylinder lock door closure device 10 of the preferred embodiment of the present invention will now be further discussed. As shown most clearly in the enlarged views of FIGS. 2B–2I, FIG. 3 and FIG. 4, the cylinder lock door closure device 10 is located on the inside of the outer cylinder 14 between the piston head 24 and the exposed or free end 30 of the piston rod 26.

The cylinder lock door closure device 10 of the present invention is shown to include an arm assembly 34, a cylindrical catch piece 36 and a hard stop 38. The arm assembly 34 includes a housing 39 which has an aperture 40 formed therein and is located on an inner surface 42 of the outer cylinder 14. As shown most clearly in FIG. 3, the arm assembly 34 further includes a first arm 44 and a second arm 46 which are mirror images of each other. Both the first arm 44 and the second arm 46 are L-shaped having a long portion 48 and a short portion 50. The short portion 50 of the first arm 44 and the second arm 46 is cylindrical in shape. The first arm 44 and the second arm 46 are separated by a cylindrical link member 52. The cylindrical link member 52 has a first end 54 and a second end 56. The first end 54 of the cylindrical link member 52 attaches to the long portion 48 of the first arm 44 by any suitable attaching means, while the second end 56 of the cylindrical link member 52 attaches to the long portion 48 of the second arm 46 by any suitable attaching means. The cylindrical link member 52 further bisects the housing 39 passing through the aperture 40 formed in the housing 39. This configuration of the arm assembly 34 allows the first arm 44 and the second arm 46 to pivot in unison about a pivot point 58. A torsion spring (not shown) is proximate to the cylindrical link member 52. The torsion spring (not shown) prevents excessive rotation of the first arm 44 and the second arm 46 about the pivot point 58 in a clockwise direction and a counterclockwise direction, and holds the arm assembly 34 in a home position when not in contact with the cylindrical catch piece 36.

The cylindrical catch piece 36 includes an outer surface 60 and a longitudinal cylindrical bore 62 formed throughout the entire length of the cylindrical catch piece 36. The cylindrical catch piece 36 attaches to the piston rod 26 by any suitable attaching means such that the piston rod 26 passes through the cylindrical bore 62 formed in the cylindrical catch piece 36. Thereby, the cylindrical catch piece 36 travels with the piston rod 26. The cylindrical catch piece 36 further includes a ramp 64, a first ledge 66 and a second ledge 68, all of which are attached to, by any suitable attaching means, or formed on the outer surface 60 of the cylindrical catch piece 36. The ramp 64 has an upper surface 70, a lower surface 72, a bottom portion 74 and a top portion 76. The ramp 64 is positioned on the outer surface 60 of the cylindrical catch piece 36 at a given angle to a longitudinal axis of the cylindrical catch piece 36. In the exemplary embodiment illustrated in FIGS. 2B–2I, this angle is approximately 30°–40°. In the preferred embodiment, this angle is approximately 60°–70°. As can be appreciated by one skilled in the art, this angle can vary accordingly. Additionally, the first ledge 66 has an upper surface 78, a lower surface 80, a front portion 82 and a rear portion 84. Similarly, the second ledge 68 also has an upper surface 86, a lower surface 88, a front portion 90 and a rear portion 92.

The hard stop 38 of the cylinder lock door closure device 10 is located on the inner surface 42 of the outer cylinder 14 and includes a cylindrical bore 94 so as not to interfere with the movements associated with the piston rod 26, the arm assembly 34 and the cylindrical catch piece 36. Accordingly, the hard stop 38 can be a round washer or any other suitable device which will not interfere with the movements of the internal components of the cylinder lock door closure device 10 while still preventing further movement of the damping spring 22 as illustrated in FIGS. 2A–2I.

Figure 2A:
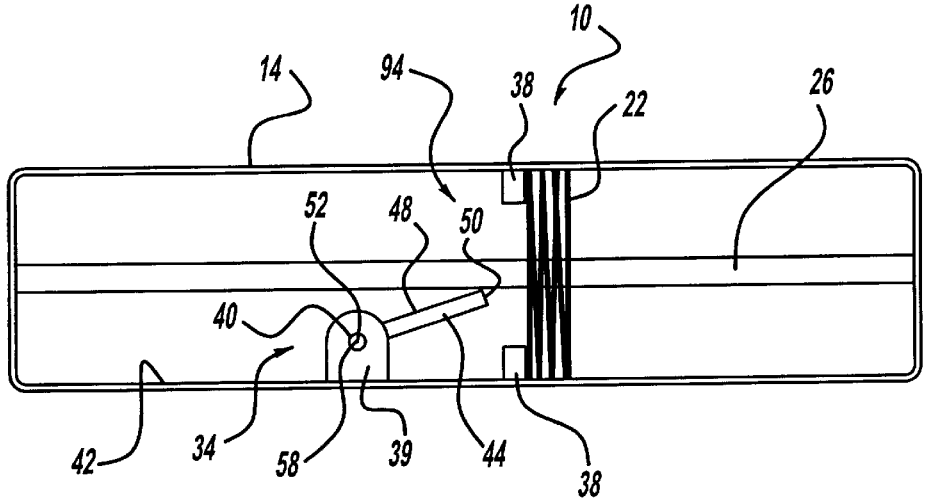
FIGS. 2A–2I are a series of simplified sectional views showing the operation of a cylinder lock door closure device constructed in accordance with the teachings of a preferred embodiment of the present invention throughout its entire range of motion.
Figure 2B:
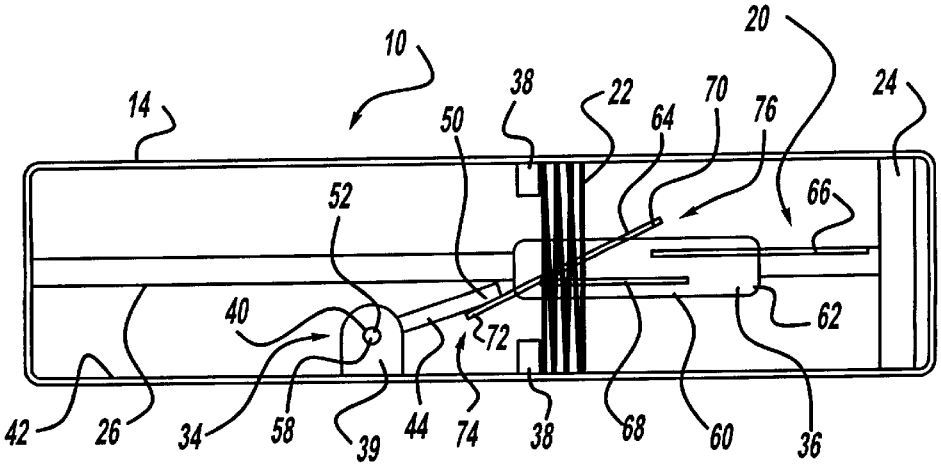
Figure 2C:
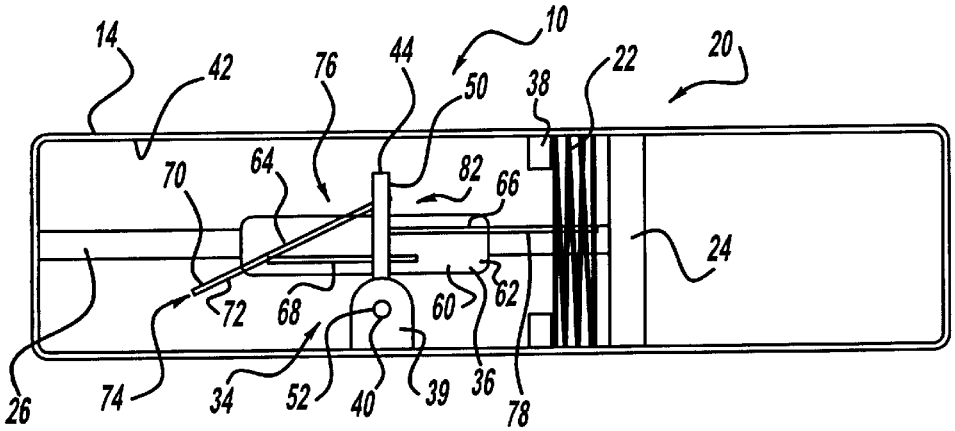

In the preferred embodiment and in operation, the door 12 is initially closed wherein the first arm 44 and the second arm 46 of the arm assembly 34 are stationary, located at a home position as illustrated in FIG. 2A. As the door 12 is opened, the piston assembly 20 including the piston head 24 and the piston rod 26, and thereby the cylindrical catch piece 36, all move appropriately. If the user opens the door 12 significantly less than 90°, the arm assembly 34 will not engage the ramp 64. However, as illustrated in FIG. 2B, as the door 12 approaches 90° open, the short portion 50 of both the first arm 44 and the second arm 46 of the arm assembly 34 makes initial contact with the upper surface 70 at the bottom portion 74 of the ramp 64. As the door 12 continues to approach 90° open, the short portion 50 of both the first arm 44 and the second arm 46 of the arm assembly 34 continues to ride the upper surface 70 toward the top portion 76 of the ramp 64. If the door 12 is not opened past 90° open, the short portion 50 of both the first arm 44 and the second arm 46 of the arm assembly 34 will travel down the upper surface 70 from the top portion 76 to the bottom portion 74 of the ramp 64, and return to its home position as illustrated in FIG. 2A. If the door 12 is opened past 90° open, the short portion 50 of both the first arm 44 and the second arm 46 of the arm assembly 34 rides on the upper surface 70 to the top portion 76 of the ramp 64 as illustrated in FIG. 2C.

Figure 2D:
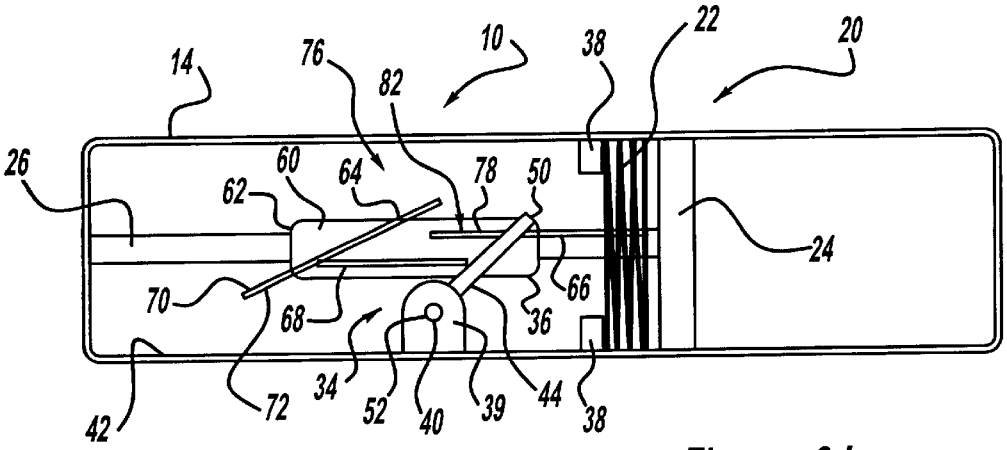
Figure 2E:
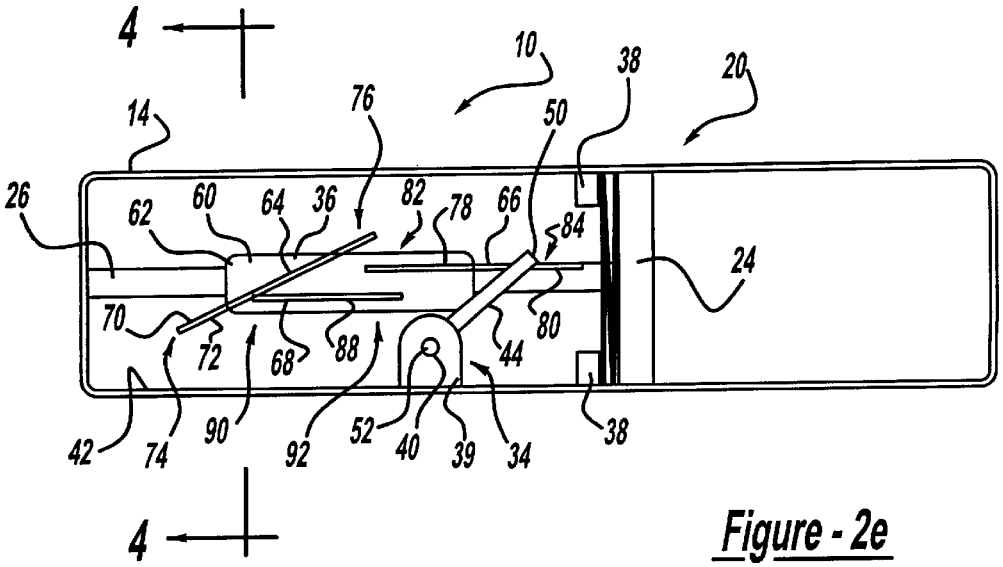

As illustrated in FIG. 2D, as the door 12 continues to open past 90° open, the short portion 50 of both the first arm 44 and the second arm 46 of the arm assembly 34 falls off of the upper surface 70 at the top portion 76 of the ramp 64 to the upper surface 78 at the front portion 82 of the first ledge 66 located below. As the door 12 continues to open to its maximum open position, the short portion 50 of both the first arm 44 and the second arm 46 of the arm assembly 34 continues to travel along the upper surface 78 from the front portion 82 to the rear portion 84 of the first ledge 66 as illustrated in FIG. 2E.

Figure 2F:
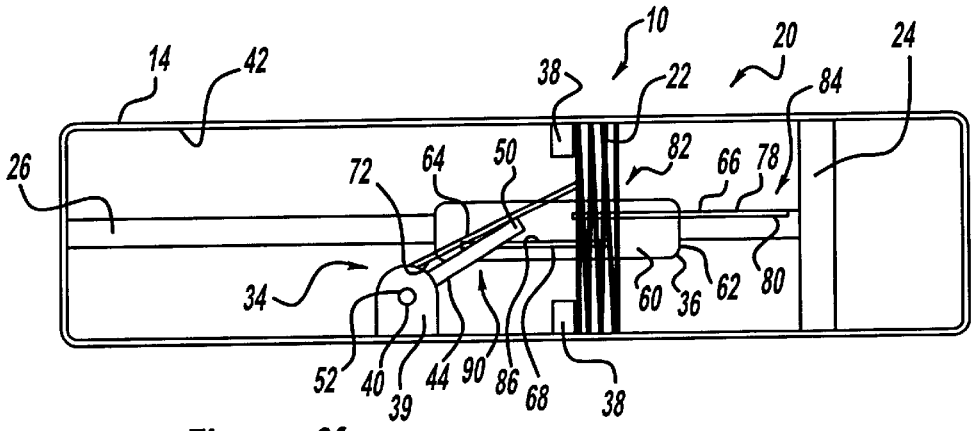

Once the door 12 is opened to its maximum open position, it is released and begins to close. As the door 12 begins to close, the short portion 50 of both the first arm 44 and the second arm 46 of the arm assembly 34 travels along the upper surface 78 from the rear portion 84 to the front portion 82 of the first ledge 66. As the door 12 continues to close, the short portion 50 of both the first arm 44 and the second arm 46 of the arm assembly 34 eventually falls off of the front portion 82 of the first ledge 66 and onto the upper surface 86 at the front portion 90 of the second ledge 68. As the door 12 continues to close, and against the forces generated by the torsion spring (now shown) proximate to the arm assembly 34 and gravity, the short portion 50 of both the first arm 44 and the second arm 46 of the arm assembly 34 is trapped between the upper surface 86 at the front portion 90 of the second ledge 68 and the lower surface 72 of the ramp 64 as illustrated in FIG. 2F thereby locking the door 12 in an open position at approximately 90° open.

Figure 2G:
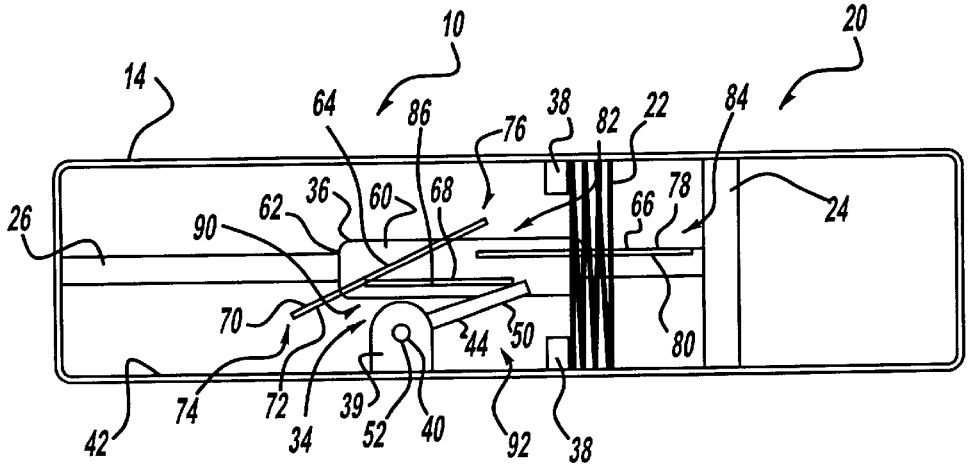

In order to release the door 12 from its locked position to enable the door 12 to close, the door 12 is tapped towards its open position. As the door 12 is tapped towards its open position, the short portion 50 of both the first arm 44 and the second arm 46 of the arm assembly 34 travels along the upper surface 86 from the front portion 90 to the rear portion 92 of the second ledge 68 eventually falling off of the upper surface 86 at the rear portion 92 of the second ledge 68 as illustrated in FIG. 2G.

Figure 2H:
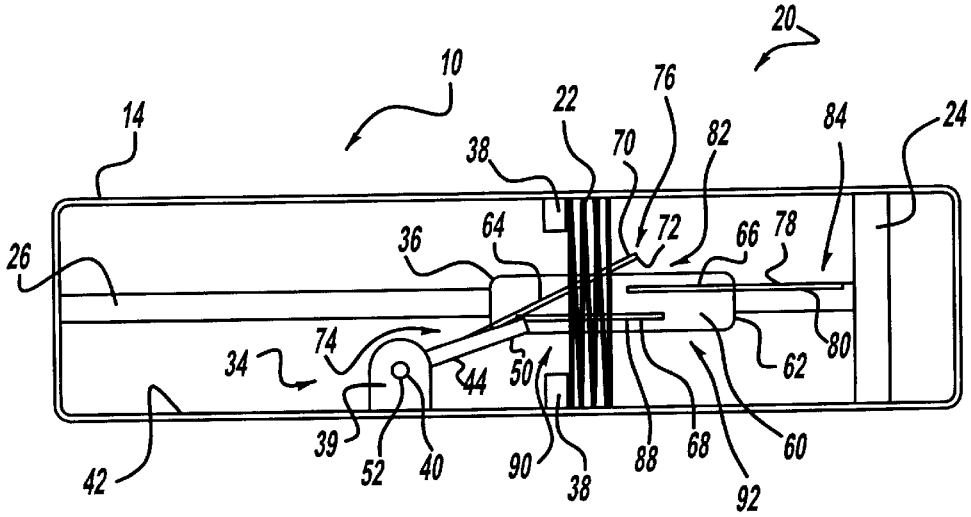

As the door 12, now released from its locked position, continues to close, the piston assembly 20, including the piston head 24 and the piston rod 26, and thereby the cylindrical catch piece 36, all move appropriately to return to their initial positions. As the door 12 continues to close, the forces of the torsion spring (not shown) allows the short portion 50 of both the first arm 44 and the second arm 46 of the arm assembly 34 to return to its home position. As the door 12 continues to close, the short portion 50 of both the first arm 44 and the second arm 46 of the arm assembly 34 travels from the rear portion 92 to the front portion 90 of the second ledge 68 just slightly below the lower surface 88 of the second ledge 68 eventually engaging the lower surface 72 of the ramp 64 as illustrated in FIG. 2H.

Figure 2I:
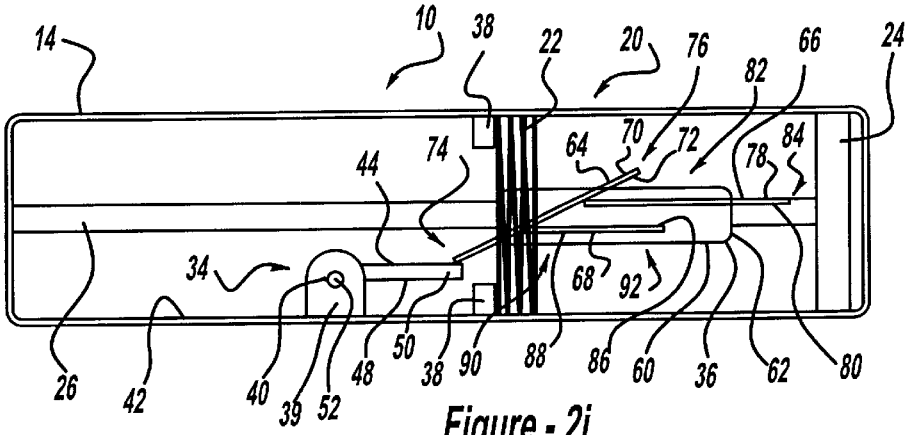
Figure 3:
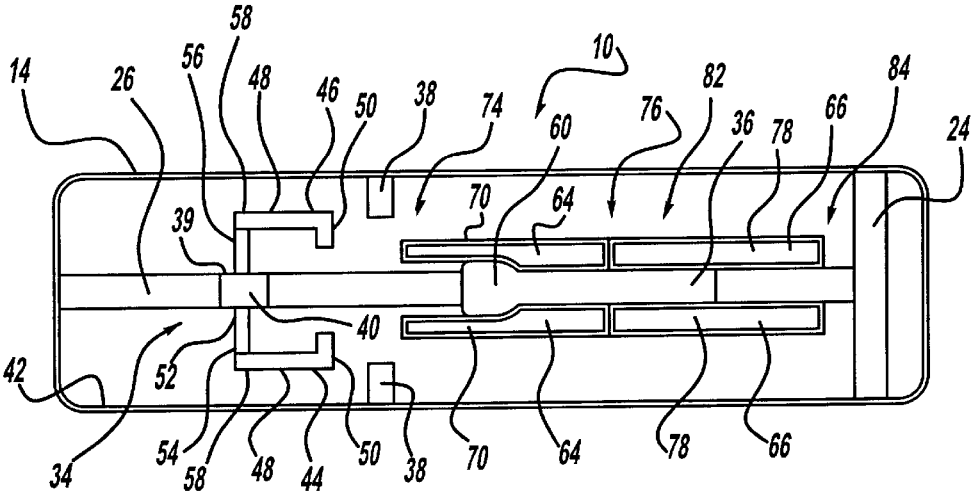
FIG. 3 is an enlarged simplified sectional top view illustrating the device of the present invention in further detail.
Figure 4:
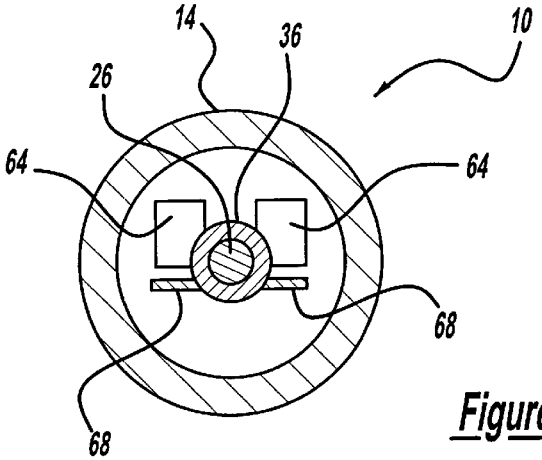
FIG. 4 is a simplified cross-sectional view taken along line 4—4 of FIG. 2E.

As the door 12 continues to close, the short portion 50 of both the first arm 44 and the second arm 46 of the arm assembly 34 continues to engage the lower surface 72 at the bottom portion 74 of the ramp 64. During this movement and continued engagement, the ramp 64 forces the first arm 44 and the second arm 46 of the arm assembly 34 down against the forces of the torsion spring (now shown) proximate to the arm assembly 34 as illustrated in FIG. 2I.

As the door 12 finishes closing, the first arm 44 and the second arm 46 cease their engagement of and are released from the lower surface 72 at the bottom portion 74 of the ramp 64 thereby causing the first arm 44 and the second arm 46 to return to their original, home position as illustrated in FIG. 2A.

The invention being thus described, it will be obvious that the same may be varied in many ways. Such variations are not to be regarded as a departure from the spirit and scope of the invention. While the above description constitutes the preferred embodiment of the invention, it will be appreciated that the invention is susceptible to modification, variation and change without departing from the proper scope or fair meaning of the accompanying claims.

What is claimed is:

1. In a building structure door assembly having a door frame, a door pivotally mounted to said door frame for movement between a fully open position and a closed position, a cylindrical housing pivotally mounted to one of said door frame and said door, and a piston assembly partially extending from said cylindrical housing and pivotally mounted to the other of said door frame and said door, an arrangement for retaining said door in a partially open position, the arrangement comprising: an arm assembly adapted to be secured to the cylindrical housing and a catch piece adapted to be secured to the piston assembly, wherein said arm assembly comprises:

a housing having an aperture formed therein secured to an inner surface of the cylindrical housing;

a link member bisecting said housing and in communication with said aperture formed therein;

a first arm secured to an end of said link member;

a second arm secured to an opposite end of said link member; and biasing means proximate said link member for preventing movement of said first arm and said second arm in a clockwise direction and a counterclockwise direction;

said arm assembly and said catch piece are operably associated such that when the door is articulated toward the fully open position during a range of articulation, said catch piece and said arm assembly cooperate to oppose articulation of the door toward the closed position.

2. The arrangement for retaining the door in a partially open position of claim 1, wherein said first arm and said second arm are mirror images of one another.

3. The arrangement for retaining the door in a partially open position of claim 1, wherein said first arm and said second arm are generally L-shaped.

4. The arrangement for retaining the door in a partially open position of claim 1, wherein said first arm and said second arm pivot in unison about said link member.

5. The arrangement for retaining the door in a partially open position of claim 1, wherein said catch piece comprises:

a cylindrical member having a longitudinally extending bore formed therein and a longitudinal axis;

a ramp member secured to said cylindrical member;

a first ledge member secured to said cylindrical member parallel to said longitudinal axis, said first ledge member operably associated with said first arm and said second arm during said range of articulation; and a second ledge member secured to said cylindrical member parallel to said longitudinal axis and to said first ledge member, said second ledge member operably associated with said first arm and said second arm during said range of articulation to oppose articulation of the door toward the closed position.

6. The arrangement for retaining the door in a partially open position of claim 5, wherein said longitudinally extending bore formed in said cylindrical member is in communication with a piston rod of the piston assembly.

7. The arrangement for retaining the door in a partially open position of claim 5, wherein said ramp forms an angle of approximately 60°–70° with said longitudinal axis.

8. An apparatus for a door pivotally mounted to a door frame, the apparatus comprising:

a housing defining an internal chamber, said housing adapted to be pivotally attached to one of the door and the door frame;

a piston assembly partially extending from said housing and adapted to be pivotally attached to the other of the door and the door frame; and a cylinder lock door closure device comprising:

an arm assembly secured to said housing;

a second housing having an aperture formed therein secured to said internal chamber of said housing;

a link member bisecting said second housing and in communication with said aperture formed therein;

a first arm secured to an end of said link member;

a second arm secured to an opposite end of said link member; and biasing means proximate said link member for preventing movement of said first arm and said second arm in a clockwise direction and a counterclockwise direction;

a catch piece secured to said piston assembly, whereby said arm assembly and said catch piece are operably associated such that when the door is articulated toward a fully open position during a range of articulation, said catch piece and said arm assembly cooperate to oppose articulation of the door toward a closed position.

9. The apparatus for a door of claim 8, wherein said first arm and said second arm are mirror images of one another.

10. The apparatus for a door of claim 8, wherein said first arm and said second arm are generally L-shaped.

11. The apparatus for a door of claim 8, wherein said first arm and said second arm pivot in unison about said link member.

12. The apparatus for a door of claim 8, wherein said catch piece comprises:

a cylindrical member having a longitudinally extending bore formed therein and a longitudinal axis;

a ramp member secured to said cylindrical member;

a first ledge member secured to said cylindrical member parallel to said longitudinal axis, said first ledge member operably associated with said first arm and said second arm during said range of articulation; and a second ledge member secured to said cylindrical member parallel to said longitudinal axis and to said first ledge member, said second ledge member operably associated with said first arm and said second arm during said range of articulation to oppose articulation of the door toward said closed position.

13. The apparatus for a door of claim 12, wherein said longitudinally extending bore formed in said cylindrical member is in communication with a piston rod of the piston assembly.

14. The apparatus for a door of claim 12, wherein said ramp forms an angle of approximately 60°–70° with said longitudinal axis.

15. The apparatus for a door of claim 8, further comprising a hard stop secured to said housing.

16. An apparatus for a door pivotally attached to a door frame for articulation between a closed position and a fully open position, the apparatus comprising:

a housing defining an internal chamber, said housing adapted to be pivotally attached to one of the door and the door frame;

a rod having a first end and a second end, said first end telescopically received within said internal chamber, said second end adapted to be pivotally attached to the other of the door and the door frame;

a cylinder lock door closure device disposed in said internal chamber and operative to initially oppose articulation of the door towards the closed position subsequent to articulation of the door toward the fully open position during a range of door articulation comprising;

an arm assembly is secured to said housing; and a catch piece is secured to said rod, wherein a cylindrical member having a longitudinally extending bore formed therein and a longitudinal axis;

a ramp member secured to said cylindrical member;

a first ledge member secured to said cylindrical member parallel to said longitudinal axis, said first ledge member operably associated with said first arm and said second arm during said range of articulation; and a second ledge member secured to said cylindrical member parallel to said longitudinal axis and to said first ledge member, said second ledge member operably associated with said first arm and said second arm during said range of articulation to oppose articulation of the door toward the closed position.

* * * * *